United States Patent [19]

Ferguson et al.

[11] Patent Number: 4,688,009

[45] Date of Patent: Aug. 18, 1987

[54] TRIPLE-PANE WAVEGUIDE WINDOW

[75] Inventors: Patrick E. Ferguson; Andrew L. Nordquist, both of Mountain View, Calif.

[73] Assignee: Varian Associates, Inc., Palo Alto, Calif.

[21] Appl. No.: 733,430

[22] Filed: May 13, 1985

[51] Int. Cl.[4] ..... H01P 1/08

[52] U.S. Cl. ..... 333/252; 333/35

[58] Field of Search ..... 333/33, 35, 252

[56] References Cited

U.S. PATENT DOCUMENTS 2,411,534 11/1946 Fox ..... 333/35

2,958,834 11/1960 Symons et al. ..... 333/252

*Primary Examiner*—Paul Gensler

*Attorney, Agent, or Firm*—Stanley Z. Cole

[57] ABSTRACT

A waveguide window contains a central transverse pane of a material with high dielectric constant such as alumina ceramic. The central pane is an integral number of half-wavelengths thick. On each side of the central pane and immediately adjacent it is a side pane of material with relatively low dielectric constant such as fused quartz. The side panes are odd numbers of quarter-wavelengths thick. The dielectric constants of the side panes are preferably the square root of the dielectric constant of the central pane. The improved wave impedance matching provides a low wave reflection over a wide frequency band.

8 Claims, 2 Drawing Figures

TRIPLE-PANE WAVEGUIDE WINDOW

The U.S. Government has rights in this invention pursuant to Contract No. DASG60-79-C-0005 between the U.S. Army and Varian Associates, Inc.

FIELD OF THE INVENTION

The invention pertains to windows of dielectric material which are commonly used to isolate a portion of a waveguide filled with gas from another portion which is evacuated or filled with a different gas. Such windows are typically made of panes of ceramic such as aluminum oxide or beryllium oxide ceramic. Windows have also been made of glass, fused quartz, single-crystal sapphire and thin mica. The ceramic type windows are generally sealed across the hollow cross section of the waveguide by metallizing the edges of the ceramic and brazing to the metallic waveguide. The mica windows, which are generally obsolete, were sealed to the waveguide by a thin fillet of melted glass. Glass windows are sealed by melting to special metal parts of the waveguide structure which have coefficients of thermal expansion matching that of the glass.

PRIOR ART

Placing a dielectric window across a uniform waveguide always creates some reflection of the wave, because the dielectric has a dielectric constant higher than the gas or vacuum in the rest of the guide. This means the wave impedance in the window material is lower. The abrupt change in impedance for a wave entering the dielectric inherently causes partial reflection of the wave. In the mica windows mentioned above and in some thin glass windows the thickness of dielectric may be made sufficiently small compared to a guide wavelength that the reflection may be neglected or cancelled by well-known matching techniques, such as reactive posts in the waveguide.

When dealing with extremely high frequencies and high powers, the window thickness becomes comparable to a guide wavelength and the reflection, which creates a standing wave in the guide outside the window, becomes an important disadvantage.

The first art toward eliminating the reflections consisted in making the window of a thickness equal to one-half of the wavelength of the transmitted wave in the dielectric-filled waveguide. In an infinite cross section the wavelength in a dielectric medium is reduced from that in free space by the square root of the dielectric constant. In a waveguide the reduction is greater than this because the cut-off frequency of the waveguide is also reduced. In the half-wavelength thick window the reflection from the fornt surface is exactly cancelled by a reflection from the rear surface when the wave leaves the dielectric. Thus for that particular thickness and frequency there is no reflection. However, as the frequency is changed from that for which the window is one-half wavelength the amount of reflected energy increases approximately linearly with the frequency deviation from that central value. Therefore the frequency band over which the half wave window has negligible reflection is limited to a value which is often unsuitably small.

An improvement in band width is described in U.S. Pat. No. 3,345,535 issued Oct. 3, 1967 to Floyd O. Johnson and Louis T. Zitelli. The invention described therein is to place a second half wave window at a distance from the first window of one-fourth of a guide wavelength in a guide filled with vacuum or gas. FIG. 1 illustrates this prior art. The hollow waveguide 10 may have a number of cross sectional shapes, such as rectangular, circular, ridged, or coaxial (not shown). The two dielectric panes 12 and 14 are exactly alike. At the center of the designed frequency band they are each one-half of the wavelength in the dielectric filled guide $\lambda_{gd}$ thick and are spaced by one-quarter of the wavelength in the empty waveguide $\lambda_{go}$.

The broad-banding can be calculated from simple waveguide theory. Some help in understanding the effect is by analogy to resonant circuits. The waves inside the panes are partly standing waves and partly traveling waves. Due to the standing wave portion each window has some analogy to a resonant circuit. Coupling the two resonances in the right phase produces a broad-banding analogous to coupled lumped-constant circuits. The pass band has a considerably flatter extent than for a single half wave window.

Other prior art pertinent to the invention is the well-known canceling of the reflection at a single discontinuity between the media of different dielectric constants such as air and glass by a layer one-quarter wavelength thick of a dielectric with dielectric constant equal to the geometric average of the dielectric constants of the two media. This system is widely used to reduce optical reflections from glass surfaces.

SUMMARY OF THE INVENTION

An object of the invention is to provide a waveguide window having very high power-handling capability and very wide frequency bandwidth.

A further object is to provide a window with protection against waveguide arcs.

DESCRIPTION OF THE PREFERRED EMBODIMENTS

Figure 1:
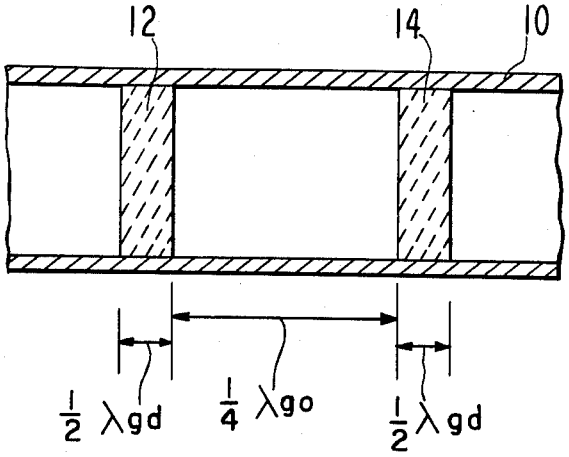
FIG. 1 PRIOR ART
FIG. 1 is a schematic section through the axis of a prior art waveguide window assembly as described above.
Figure 2:
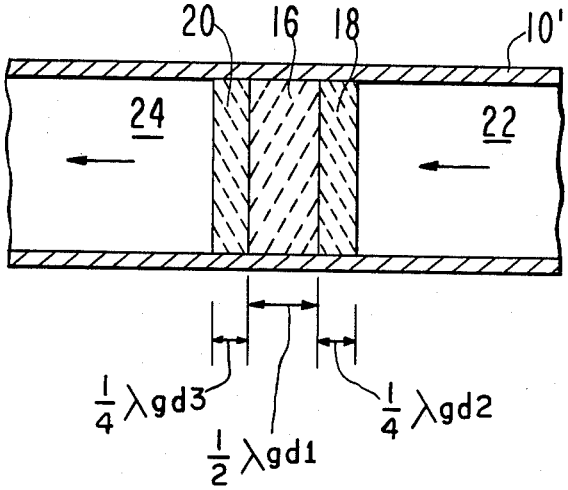
FIG. 2 is a schematic section through the axis of a waveguide window assembly embodying the invention.

The essence of the invention is illustrated by FIG. 2. Across the hollow interior of a waveguide 10' is a pane of dielectric material 16 having relatively high dielectric constant. Suitable materials for extremely high powers and frequencies are aluminum oxide ceramic, beryllium oxide ceramic, single-crystal sapphire and fused quartz. Pane 16 is typically hermetically sealed across waveguide 10' by metallizing the dielectric via well-known processes such as sintering a powdered molybdenum-manganese mixture to the edge surfaces which are subsequently brazed to the waveguide. At the center frequency, pane 16 has a thickness of one-half the wavelength in the dielectric-filled waveguide $\lambda_{gdl}$ where dl is its dielectric constant.

In contact with the exposed faces of pane 16 are a pair of panes 18 and 20 of materials having lower dielectric constants d2 and d3 than central pane 16. Panes 18 and 20 are preferably of a thickness equal to one-fourth of the wavelength at the desired center frequency in the waveguide filled with the material of the respective panes. The dielectric constants d2 and d3 of panes 18 and 20 are chosen to match the waves in the input waveguide 22 and output waveguide 24 to the wave in the central pane 16. At the center frequency the wave in central pane 16 is then a pure traveling wave, whereby the electric field in pane 16 is minimized. Also, the window assembly has reduced reflections over a wider bandwidth than prior-art windows. In this respect it is somewhat analogous to a triple tuned circuit. An experimental window in which the central pane was an alumina ceramic and the side panes were fused quartz exhibited a voltage standing wave ratio (VSWR) less than 1.5 over a ten percent bandwidth.

The dielectric constant of fused quartz, 3.8, is not exactly the square root of that of high-alumina ceramic, about 9.0. Nevertheless, it seems to be close enough to provide a well-matched window.

An advantage of the inventive window construction using quartz side panes is that it is not necessary to make a hermetic seal of the quartz to the metallic waveguide. The outside panes 18, 20 may be only mechanically constrained in place, by methods not shown. Since quartz has an extremely low coefficient of thermal expansion and is mechanically somewhat weak, it has proven to very difficult to make a quartz-to-metal seal without intermediate grading glasses. Thus, pure quartz windows have not been widely used.

Another advantage of the inventive window is in protection from waveguide arcs. In a gas-filled waveguide carrying high continuous-wave power, an rf voltage breakdown causes an arc across the guide which travels toward the power source at a speed which increases with the power level. If the arc reaches the output window of the microwave generator tube, its intense localized heat can melt or thermally crack the window, destroying the tube. In the prior art, it was known to place a second window outside the hermetic vacuum window to stop the arc's progress, at least temporarily. The fused silica pane of the inventive window can provide this added function. Fused quartz has very low thermal expansion, so is highly resistant to cracking by heat shock. Since the matching quartz pane may not be sealed to the central hermetic pane, its failure alone will not cause failure of the tube.

The above described window is a preferred embodiment. Other structures and materials may be used within the scope of the invention. The central pane may be any whole number of half-wavelengths thick. The outside panes may be any odd number of quarter-wavelengths thick. Adding a half-wavelength to a pane thickness causes the wave reflected on leaving the pane to arrive at the entry surface in the same phase.

The scope of the invention is to be limited only by the following claims and their legal equivalents.

What is claimed is:

1. A waveguide window comprising:

a section of hollow waveguide adapted to transmit a wave with transverse electric field;

a first pane of dielectric having a first dielectric constant, extending across the open cross-section of said guide;

a second pane of dielectric having a second dielectric constant extending substantially across said cross-section, said second pane having a surface adjacent a first transverse surface of said first pane;

a third pane of dielectric having a third dielectric constant extending substantially across said cross-section, said third pane having a surface adjacent the second transverse surface of said first pane, said transverse surfaces are planes perpendicular to the direction of propagation of said wave;

the dielectric constants of said second and third panes being substantially equal to the square root of said first dielectric constant.

2. A waveguide window comprising:

a section of hollow waveguide adapted to transmit a wave which possesses a transverse electric field perpendicular to the direction of propagation of said wave;

a first pane of dielectric possessing a first dielectric constant and a first pair of parallel surfaces spaced apart substantially an integral number of half-wavelengths of said wave disposed across an open cross-section of said waveguide with said first pair of parallel surfaces perpendicular to the direction of propagation of said wave;

a second pane of dielectric possessing a second dielectric constant substantially lower than said first dielectric constant and a second pair of parallel surfaces spaced apart substantially an odd number of quarter-wavelengths of said wave disposed substantially across said open cross-section with one of said second pair of parallel surfaces adjacent one of said first pair of parallel surfaces; and a third pane of dielectric possessing a third dielectric constant substantially lower than said first dielectric constant and a third pair of parallel surfaces spaced apart substantially an odd number of quarter-wavelengths of said wave disposed substantially across said open cross-section with one of said third pair of parallel surfaces adjacent the other of said first pair of parallel surfaces.

3. The window of claim 2 wherein said second and third dielectric constants are substantially equal to the square root of said first dielectric constant.

4. The window of claim 2 wherein said wave has circular electric fields.

5. The waveguide of claim 2 wherein said first pane is largely aluminum oxide.

6. The waveguide of claim 5 wherein said second and third panes are fused silica.

7. The window of claim 2 wherein said first pane is hermetically sealed across waveguide and said second and third panes are not sealed to said first pane.

8. The window of claim 7 wherein said second and third panes are not hermetically sealed to said waveguide.

* * * * *